US008651620B2

(12) United States Patent
Yamada et al.

(10) Patent No.: US 8,651,620 B2
(45) Date of Patent: Feb. 18, 2014

(54) EJECTION LIQUID DRYNESS SUPPRESSING DEVICE, LIQUID EJECTING APPARATUS, AND EJECTION LIQUID DRYNESS SUPPRESSING METHOD

(75) Inventors: Yoichi Yamada, Shiojiri (JP); Yoshiyuki Kurebayashi, Chiba (JP); Masaru Kobashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 158 days.

(21) Appl. No.: 13/151,460

(22) Filed: Jun. 2, 2011

(65) Prior Publication Data

US 2011/0298865 A1 Dec. 8, 2011

(30) Foreign Application Priority Data

Jun. 3, 2010 (JP) ..... 2010-128012

(51) Int. Cl.
*B41J 2/135* (2006.01)
*B41J 2/165* (2006.01)

(52) U.S. Cl.
USPC ..... 347/44; 347/29; 347/32

(58) Field of Classification Search
None
See application file for complete search history.

(56) References Cited

U.S. PATENT DOCUMENTS

2006/0209140 A1* 9/2006 Nagai ..... 347/85
2010/0310169 A1* 12/2010 Liu et al. ..... 382/171

FOREIGN PATENT DOCUMENTS

JP 2002-292885 A 10/2002
JP 2009-029113 A 2/2009

* cited by examiner

*Primary Examiner* — Lisa M Solomon
(74) *Attorney, Agent, or Firm* — Workman Nydegger

(57) ABSTRACT

There is provided a nozzle contact unit capable of realizing a contact state, where a contact surface comes into close contact with a nozzle formation surface to block a plurality of nozzle openings, and a separated state, where the contact surface is separated from the nozzle formation surface. The nozzle contact unit separates the contact surface from the nozzle formation surface to sequentially open the nozzle openings preferentially from the nozzle opening of the nozzle with a shorter flow passage length of ink flowing from a supply port to the nozzle via a common ink chamber among the plurality of nozzle openings in a procedure from the contact state to the separated state.

13 Claims, 6 Drawing Sheets

EJECTION LIQUID DRYNESS SUPPRESSING DEVICE, LIQUID EJECTING APPARATUS, AND EJECTION LIQUID DRYNESS SUPPRESSING METHOD

CROSS REFERENCES TO RELATED APPLICATIONS

The entire disclosure of Japanese Patent Application No. 2010-128012, filed Jun. 3, 2010 is expressly incorporated by reference herein.

BACKGROUND

1. Technical Field

The present invention relates to an ejection liquid dryness suppressing device, a liquid ejecting apparatus, and an ejection liquid dryness suppressing method.

2. Related Art

There is known a liquid ejecting apparatus that forms a predetermined image (including characters, figures, and the like) by allowing a liquid ejecting unit (for example, a printing head) to eject an ejection liquid (for example, ink) toward a medium (for example, a sheet). Such a liquid ejecting apparatus includes an ejection liquid dryness suppressing device capable of suppressing drying of the ejection liquid in the liquid ejecting unit so as to stably eject from the liquid ejecting unit. The ejection liquid dryness suppressing device can be equipped in the liquid ejecting unit to suppress the drying of the ejection liquid by bringing a contact member into contact with a nozzle formation surface in which nozzle openings are formed, which are the end openings of the nozzles ejecting the ejection liquid, and covering the nozzle openings with the contact member, when no image is being formed. The contact member brought into contact with the nozzle formation surface is separated from the nozzle formation surface in the ejection liquid dryness suppressing device so that the ejection liquid is ejected from the nozzle openings, when an image is being formed.

As such a kind of device, there is known a device (capping device) configured to cover the nozzle formation surface by allowing the cap-shaped contact member to form a closed space between the cap-shaped contact member and the nozzle formation surface. In such a device, there is a little concern that a meniscus (interface between the ejection liquid and the atmosphere) formed in the nozzle is broken down due to the contact member, since the contact member does not come into direct contact with the nozzle openings. However, there is a concern that a solvent component evaporating until the pressure of the closed space reaches a saturated vapor pressure and thus the ejection liquid dries out.

In order to suppress the drying of the ejection liquid, there have been suggested various techniques capable of stably forming the meniscus by bringing the contact member into direct contact with the nozzle formation surface without a space, that is, by closely contacting the contact member with the nozzle formation surface and covering the nozzle openings with the contact member (for example, JP-A-2002-292885 and JP-A-2009-029113).

However, in the devices disclosed in JP-A-2002-292885 and JP-A-2009-029113, it is actually difficult to allow nozzle formation surface or the contact surface of the contact member to be completely flat. Accordingly, since it is considerably difficult to simultaneously open all of the blocked nozzle openings, there are nozzles in which the nozzle openings are not opened and the nozzles in which the nozzle openings have already been opened in the blocked nozzle openings.

However, for example, in the contact state of the contact member, the ink exudes from the nozzle openings, in which the ink is contacted with the contact surface, due to capillarity occurring between the contact surface and the nozzle formation surface at the moment when the contact surface is separated from the nozzle formation surface. In this case, the amount of exuded ink is supplied and supplemented from the common liquid chamber (reservoir) communicating with each nozzle.

At this time, when there are the nozzles in which the nozzle openings have not yet been opened and the nozzles in which the nozzle openings have already been opened, the supplementary ink is supplied from the nozzles in which the nozzle openings have already been opened. That is, since the atmosphere (air) can intrude into the opened nozzle opening in the nozzle in which the nozzle opening is opened, the ink in the nozzle can flow toward the common liquid chamber from the nozzle opening. Therefore, since the ink is supplemented to the nozzle, in which the nozzle opening has not yet been opened, from the nozzle, in which the nozzle opening has already been opened, via the common liquid chamber, the ink in the nozzle in which the nozzle opening has already been opened may be decreased.

In the nozzle in which the ink is decreased, the meniscus in the nozzle is drawn inward and thus the position of the formed meniscus may be changed. As a consequence, the meniscus is moved and formed at a position different from the position at which the meniscus is to be formed when an image is formed. Therefore, a problem may arise in that the amount of ejection liquid may not be correctly ejected from the nozzle openings to form the image, and thus, for example, dot omission occurs.

SUMMARY

An advantage of some aspects of the invention is that it provides an ejection liquid dryness suppressing device, an ejection liquid dryness suppressing method, and a liquid ejecting apparatus including the ejection liquid dryness suppressing device capable of suppressing a change in the positions of meniscuses formed in nozzles when nozzle openings are opened from a contact state where the nozzle openings are blocked by the close contact of a contact surface.

According to an aspect of the invention, there is provided an ejection liquid dryness suppressing device including: a liquid ejecting unit including a plurality of nozzles which ejects an ejection liquid from a plurality of nozzle openings formed in a nozzle formation surface, a common liquid chamber which communicates with the plurality of nozzles and supplies the ejection liquid to the plurality of nozzles, and a supply port through which the ejection liquid is supplied to the common liquid chamber; and a nozzle contact unit having a contact surface which is able to come into contact with the nozzle formation surface and realizing a contact state, where the contact surface comes into close contact with the nozzle formation surface to block the plurality of nozzle openings, and a separated state, where the contact surface is separated from the nozzle formation surface. In the procedure from the contact state to the separated state, the nozzle contact unit separates the contact surface from the nozzle formation surface so as to sequentially open the nozzle openings preferentially from the nozzle opening of the nozzle with the shortest flow passage for the ejection liquid flowing from the supply port to the nozzle via the common liquid chamber among the plurality of nozzle openings.

With such a configuration, when the blocked nozzle openings are opened, the nozzles in which the nozzle openings have already been opened are shorter than the nozzles in which the nozzle openings are being opened, in the flow passage length of the liquid flowing from the supply port via the common liquid chamber. As a consequence, even when the ejection liquid is decreased in the nozzle in which the nozzle opening has already been opened to supplement the ejection liquid, the ejection liquid is supplied to the nozzle in which the nozzle opening has been opened so as to supplement the amount of decrease in liquid from the supply port. Accordingly, since a change in the amount of ejection liquid is suppressed in the nozzle in which the nozzle opening has been opened, the position of the meniscus formed in each nozzle can be stabilized in the separated state. As a consequence, for example, it is possible to prevent ejection omission in which the ejection liquid is not ejected from the nozzle opening.

In the ejection liquid dryness suppressing device according to the aspect of the invention, the plurality of nozzle openings may be arranged in a nozzle row in one direction on the nozzle formation surface and the flow passage length my become longer in an arrangement order of the nozzle row from the nozzle opening of the nozzle with the shortest flow passage length.

With such a configuration, for example, the contact surface formed as one planar surface in the arrangement order of the nozzles is separated. Therefore, even when there is a part which is not flat in the contact surface, the nozzle openings can be opened at high certainty in the arrangement order, that is, the order by shortest flow passage length. Accordingly, in the nozzle in which the nozzle opening has already been opened, the ejection liquid can be supplemented from the supply port at high certainty so as not to decrease the ejection liquid. As a consequence, since a change in the amount of ejection liquid is suppressed in the nozzle in which the nozzle opening has been opened, the position of the meniscus formed in each nozzle can be stabilized in the separated state.

In the ejection liquid dryness suppressing device according to the aspect of the invention, the nozzle with the shortest flow passage length for the ejection liquid from the supply port to the nozzle may be the nozzle of the nozzle opening located at the furthest end of the nozzle row.

With such a configuration, since the contact surface can be separated from the nozzle formation surface in the order from the nozzle opening located at the furthest end of the nozzle row, the contact surface can be separated easily and reliably in the arrangement order, that is, the order by shortest flow passage length. As a consequence, the amount of ejection liquid supplemented in the nozzle in by the amount of decrease in ejection liquid with regard to the nozzle opening is being opened can reliably be supplemented from the supply port in the nozzle in which the nozzle opening has already been opened. Accordingly, since it is possible to suppress the change in the amount of ejection liquid in the nozzle in which the nozzle opening has been opened, the position of the meniscus formed in each nozzle can be stabilized in the separated state.

In the ejection liquid dryness suppressing device according to the aspect of the invention, a plurality of the nozzle rows arranged in a row direction may be formed on the nozzle formation surface in the liquid ejecting unit. The nozzle with the shortest flow passage length for the ejection liquid flowing from the supply port to the nozzle may be each of the nozzles located at the furthest ends of the plurality of nozzle rows on the same side.

With such a configuration, the contact surface may be separated so as to open the nozzle openings from the nozzle openings at the ends of all the plurality of nozzle rows on the same side. Therefore, even when the plurality of nozzle rows is formed, the nozzle rows can be covered with the contact surface formed as, for example, one planar surface. Accordingly, the configuration of the nozzle contact unit becomes simple and the nozzle openings can be opened at high certainty in the arrangement order by separating the one planar surface even when the plurality of nozzle rows is formed. Therefore, the ejection liquid can reliably be supplemented from the supply port in the nozzle in which the nozzle opening has already been opened. As a consequence, since it is possible to suppress the change in the amount of ejection liquid in the nozzle in which the nozzle opening has been opened, the position of the meniscus formed in each nozzle can be stabilized in the separated state.

In the ejection liquid dryness suppressing device according to the aspect of the invention, the nozzle with the shortest flow passage length for the ejection liquid from the supply port to the nozzle may be the nozzle of the nozzle opening located at the middle of the nozzle row.

With such a configuration, even when the nozzle with the shortest flow passage length of the liquid flowing from the supply port via the common liquid chamber is not located at the end of the nozzle row but is located in the middle of the nozzle row, the contact surface formed as one planar surface is separated in the arrangement order from the middle nozzle of the nozzle row toward both sides. Accordingly, since the nozzle openings can be opened at high certainty in the arrangement order, that is, the order by shortest flow passage length, the ejection liquid can be supplemented from the supply port at high certainty so as not to decrease the ejection liquid in the nozzle in which the nozzle opening has already been opened. As a consequence, since the change in the amount of ejection liquid is suppressed in the nozzle in which the nozzle opening has been opened, the position of the meniscus formed in each nozzle can be stabilized in the separated state.

In the ejection liquid dryness suppressing device according to the aspect of the invention, the liquid ejecting unit may have a plurality of the supply ports in one nozzle row. The contact surface of the nozzle contact unit may be separated from the nozzle formation surface from the nozzle openings with the shortest flow passage length in the plurality of supply ports so as to simultaneously begin opening the plurality of nozzle openings.

With such a configuration, in a case where there is a plurality of supply ports, the contact surface is separated so that the nozzle, in which the nozzle opening has already been opened is shorter than the nozzle in which the nozzle opening is being opened, in the flow passage length, when the nozzle openings are opened. Accordingly, even when there is the plurality of supply ports, the position of the meniscus formed in each nozzle can be stabilized in the separated state. This is because the amount of ejection liquid in the nozzle in which the nozzle opening has been opened can be reliably supplemented by the amount of decrease in the ejection liquid from the supply port, when the contact surface is separated from the nozzle formation surface.

According to another aspect of the invention, there is provided a liquid ejecting apparatus including the ejection liquid dryness suppressing device with the above-described configuration; and a movement unit relatively moving the liquid ejecting unit of the ejection liquid dryness suppressing device and a medium to which an ejection liquid is ejected.

With such a configuration, it is possible to obtain the same operations and the same advantages as those of the ejection liquid dryness suppressing device with the above-described configuration.

According to still another aspect of the invention, there is provided an ejection liquid dryness suppressing method including: by a nozzle contact unit having a contact surface coming into contact with a nozzle formation surface of a liquid ejecting unit in which a plurality of nozzle openings of a plurality of nozzles ejecting an ejection liquid are formed, during a procedure from a contact state, where the contact surface comes into close contact with the nozzle formation surface to block the plurality of nozzle openings, to a separated state, where the contact state is separated from the nozzle formation surface, separating the contact surface of the nozzle contact unit from the nozzle formation surface to sequentially open the nozzle openings preferentially from the nozzle opening of the nozzle with a shortest flow passage length for the ejection liquid flowing from a supply port formed in the liquid ejecting unit to the nozzle via the common liquid chamber among the plurality of nozzle openings.

According to such a method, it is possible to obtain the same operations and the same advantages as those of the ejection liquid dryness suppressing device with the above-described configuration.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
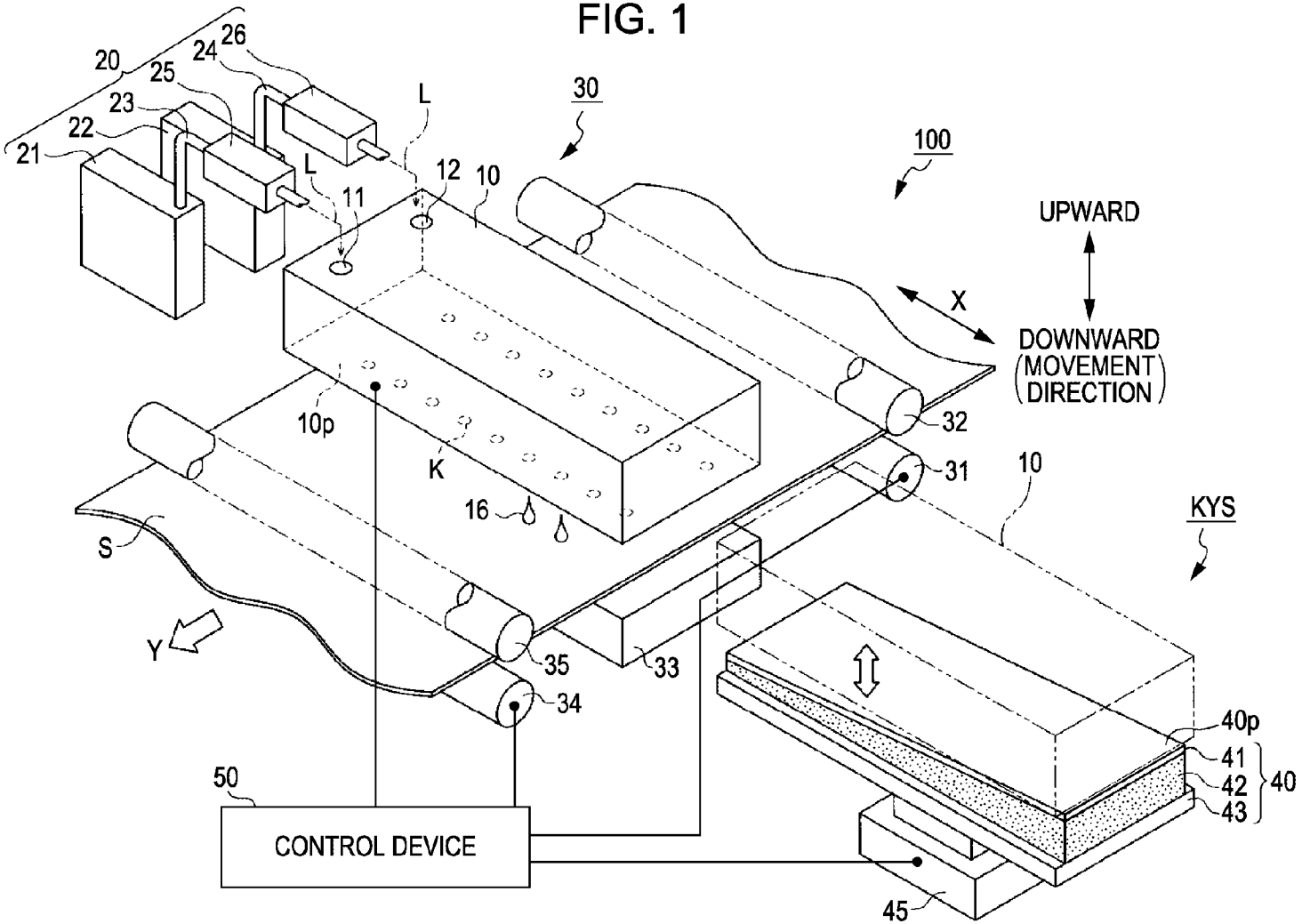
FIG. 1 is a perspective view illustrating the overall configuration of a liquid ejecting apparatus including an ejection liquid dryness suppressing device according to a first embodiment.

Hereinafter, a specific embodiment of the invention will be described with reference to the drawings. FIG. 1 is a diagram illustrating the overall configuration of a printing apparatus 100 serving as a liquid ejecting apparatus including an ejection liquid dryness suppressing device (hereinafter, simply referred to as a "dryness suppressing device") according to a first embodiment. As illustrated, the printing apparatus 100 includes a printing head 10 serving a liquid ejecting unit ejecting ink which is an ejection liquid. The printing apparatus 100 ejects the ink toward a sheet S which is a medium transported relative to the printing head 10 from the printing head 10 to form an image. The medium is not particularly limited to a sheet (paper sheet), but other materials such as ceramic, glass, wood, metal, resin, and cloth may be used.

A sheet S is supplied from a sheet feeding tray (not shown). The sheet S is transported so as to pass between the printing head 10 and a platen (support table of the sheet S) 33 facing the printing head 10 in a state where the sheet S is pinched between a sheet feeding roller 31 driven rotatably by a driving unit (motor or the like) (not shown) and a driven roller 32. The printing head 10 has nozzles (not shown) ejecting the ink. Ink droplets 16 are ejected from the openings located at the respective ends of the nozzles, that is, nozzle openings K toward the sheet S being transported to form an image. In this embodiment, a gravity direction is assumed to be a downward direction and the direction opposite the gravity direction is assumed to be an upward direction. The ink droplets 16 are configured to be ejected in the downward direction.

The nozzle openings K are formed in a nearly flat nozzle formation surface 10*p* facing the sheet S on the lower side of the printing head 10. In this embodiment, a plurality of nozzles is formed. The plurality of nozzle openings K is formed so that the nozzles are arranged in nearly a single line in an X direction intersecting the Y direction which is the transport direction of the sheet S being transported. Moreover, the nozzle openings are formed nearly in the width direction of the sheet S. In this embodiment, accordingly, a so-called head-type printing device 100 is used.

Thereafter, the sheet S passing through the paten 33 is transported in the Y direction in a state where the sheet S is pinched between a sheet discharging roller 34 driven rotatably by a driving unit (motor or the like) (not shown) and a driven roller 35. Finally, the sheet S is discharged from the printing apparatus 100 to a sheet discharging tray (not shown). Accordingly, at least the sheet feeding roller 31 and the sheet discharging roller 34 function as a movement unit 30 which moves the sheet S relative to the printing head 10.

As illustrated, the printing apparatus 100 includes an ink supply unit 20 serving as a supply unit which supplies ink L to be ejected to the printing head 10. As illustrated, the ink supply unit 20 has two supply passages which respectively supply the ink L to two supply ports 11 and 12 formed in the printing head 10. Specifically, ink tanks 21 and 22 storing the ink L to be supplied and pipes 23 and 24 through which the ink L is supplied from the ink tanks 21 and 22 are installed to supply the ink L to the supply ports 11 and 12, respectively.

In this embodiment, supply control units 25 and 26 controlling the supply of the ink L to be supplied to the printing head 10 through the use of a valve mechanism are installed in the midway of the pipes 23 and 24, respectively. Accordingly, the ink L supplied from the supply ports 11 and 12 to the nozzles of the printing head 10 is configured to apply a predetermined back pressure (negative pressure) to the ink L in the respective nozzles in forming an image by the supply control units 25 and 26.

As illustrated, the printing apparatus 100 includes a nozzle contact unit 40 to suppress drying of the ink L in the nozzles, for example, when an image is not formed on the sheet S. The nozzle contact unit 40 includes a contact member 41 having a contact surface 40*p*, an elastic member 42 holding the contact member 41 and bringing nearly the entire contact surface 40*p* of the contact member 41 into contact with the nozzle formation surface 10*p*, and a plate 43 holding the elastic member 42.

The plate 43 is configured so as to be moved vertically by a driving device 45. In this embodiment, the printing head 10 is configured to be moved in a sliding manner in the X direction by a slide mechanism (not shown) between a position upward facing the sheet S and a position opposite from the upper side of the contact surface 40*p* of the nozzle contact unit 40. Accordingly, by vertically moving the nozzle contact unit 40 with respect to the printing head 10 moved in the sliding manner in the X direction so as to face the contact surface 40*p*, the contact surface 40*p* can be brought into contact with the nozzle formation surface 10*p* of the printing head 10 or can be separated from the nozzle formation surface 10*p*.

The printing apparatus 100 includes a control device 50. The driving device 45 moves up and down the nozzle contact unit 40 under the control of the control device 50. The control device 50 controls pressurizing units (not shown) equipped in pressurizing chambers 15 (see FIG. 2B) installed inside the printing head 10 to eject the ink droplets 16 of a liquid amount corresponding to an image to be formed from the nozzle openings K. The control device 50 controls the rotation of the sheet feeding roller 31 and the sheet discharging roller 34 together with the control of the ejection of the ink droplets 16. Moreover, the control device 50 controls various kinds of operations (for example, the sliding movement of the printing head 10) of the printing apparatus 100.

Accordingly, in the printing apparatus 100 according to this embodiment, the nozzle contact unit 40, the driving device 45, and the control device 50 function as a dryness suppressing device KYS which suppresses the drying of the ink L in the nozzles of the printing head 10. Specifically, when the dryness suppressing device KYS suppresses the drying of the nozzles in the printing apparatus 100, the slide mechanism (not shown) first moves the printing head 10 in the X direction until the printing head 10 is located at the position facing the nozzle contact unit 40. Then, the driving device 45 moves up the nozzle contact unit 40 and thus the contact surface 40*p* is brought into contact with the nozzle formation surface 10*p* so that the nozzle contact unit 40 comes into close contact with the entire region of nozzle openings K1 to K9 and the nozzle openings K1 to K9 are not individually blocked without being opened to the atmosphere. Thus, since the ink L in nozzles NL1 to NL9 is not opened to the atmosphere and is brought into contact with the nozzle contact unit 40, the drying of the ink L is suppressed.

Figure 2A:
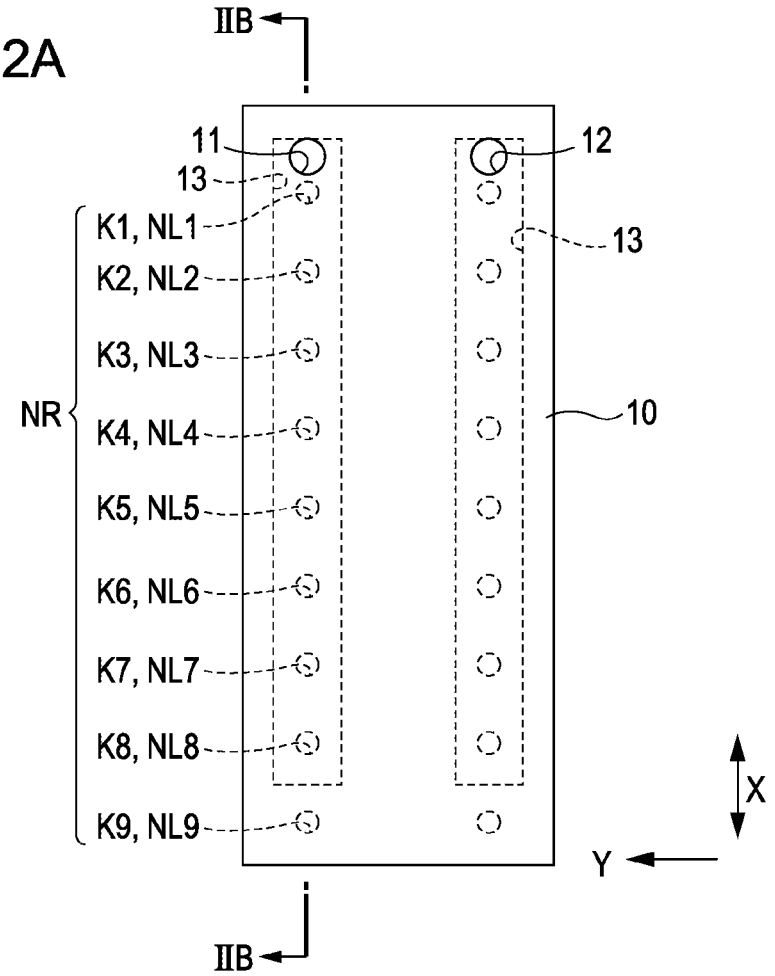
FIG. 2A is a plan view illustrating a printing head when viewed from the upper side.
Figure 2B:
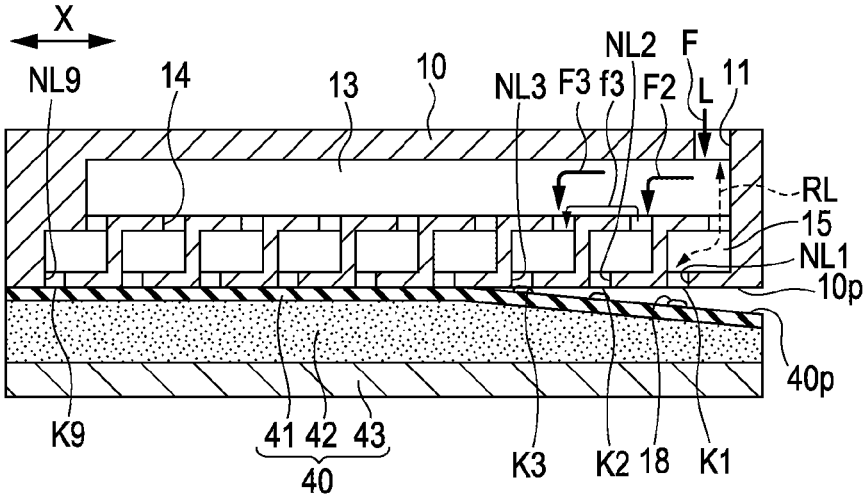
FIG. 2B is a sectional view illustrating the ejection liquid dryness suppressing device taken along the line IIB-IIB of FIG. 2A.

Next, an operation of the nozzle contact unit 40 of the dryness suppressing device KYS which suppresses the drying of the ink L in the printing apparatus 100 will be described in detail with reference to FIGS. 2A and 2B. FIG. 2A is a plan view illustrating the printing head 10 moved in the sliding manner to the position facing the nozzle contact unit 40 when viewed from the upward direction. FIG. 2B is a sectional view taken along the line IIB-IIB of FIG. 2A. In FIG. 2B, the nozzle contact unit 40 brought into contact with the nozzle formation surface 10*p* comes to be separated from the nozzle formation surface 10*p*.

In the printing head 10 according to this embodiment, as shown in FIGS. 2A and 2B, nine nozzles NL1 to NL9 ejecting the ink L to be supplied to the respective supply ports 11 and 12 are formed in each of the supply ports 11 and 12. The respective nozzle openings K1 to K9 which are end openings of the respective nozzles NL1 to NL9 indicate two nozzle rows NR arranged in one direction directed along the X direction. The respective nozzle rows NR are arranged in the Y direction at a predetermined interval on the nozzle formation surface 10*p*. In this embodiment, these nozzle rows are arranged in order to facilitate description. Of course, one nozzle row or two or more nozzle rows (supply ports) may be arranged. As for the number of nozzles (the number of nozzle openings), more nozzles (nozzle openings) may be formed in one nozzle row (for example, normally, several tens to several thousands of nozzles may be formed). In the following description of this embodiment, the nozzles NL1 to NL9 are referred to as the nozzles NL when the nozzles NL1 to NL9 are not distinguished from each other. Moreover, when the nozzle openings K1 to K9 are not distinguished from each other, the nozzle openings K1 to K9 are referred to as the nozzle openings K.

In the two nozzle rows NR, the ink L supplied from the supply port 11 or 12 is configured to be supplied to the respective nozzles NL1 to NL9 via ink flow passages formed in the printing head 10. Here, the ink flow passages through which the ink L supplied to the supply port 11 is ejected from the respective nozzle openings K in the two nozzle rows NR formed in the nozzle formation surface 10*p* will be described with reference to FIG. 2B. Of course, the ink flow passage through which the ink L supplied to the supply port 12 is ejected from the respective nozzle openings K in the other nozzle row NR is the same as an ink flow passage described below.

As shown in FIG. 2B, the ink L supplied from the supply port 11 first flows in a common ink chamber 13 serving as a common liquid chamber, as indicated by the arrow F. The common ink chamber 13 is an ink chamber extending from the nozzles NL1 to NL9 in the X direction and functions as a reservoir which stably supplies the ink L to the respective nozzles NL1 to NL9. Thereafter, the ink L having flowed in the common ink chamber 13 flows in pressurizing chambers 15 via communication flow passages 14 communicating with the common ink chamber 13. The communication flow passage 14 and the pressurizing chamber 15 are formed so as to correspond to each nozzle NL, and the ink L flowing in the pressurizing chamber 15 is configured to be guided to each of the nozzles NL1 to NL9 communicating with each of the pressurizing chambers 15.

A pressurizing unit (not shown) configured by an electrostrictive element, a heating element, or the like is installed in the pressurizing chamber 15 so as to pressurize the ink L in the pressurizing chamber 15. Then, the ink L pressurized by the pressurizing unit is configured to be ejected from each of the nozzle openings K installed in the nozzle formation surface 10*p* via each of the nozzles NL communicating with the pressurizing chamber 15. In the drawings used for the following description in addition to FIG. 2B, the communication flow passage 14, the pressurizing chamber 15, and the nozzle NL are schematically illustrated so as to be functionally equivalent. Therefore, the actual communication flow passage, the pressurizing chamber, and the nozzle may be different therefrom.

In the nozzle contact unit 40, an inclined surface inclined downward from the nozzle NL9 to the nozzle NL1 in the X direction is formed by one planar surface, when the contact surface 40*p* and the nozzle formation surface 10*p* are separated from each other before the contact (see FIG. 1). Specifically, in this embodiment, the contact member 41 having contact surface 40*p* thereon is formed of an elastic member such as a synthetic rubber (for example, CR (chloroprene) or EPDM (ethylene-propylene-diene-terpolymer) rubber) on a flat plate. The elastic member 42 has a shape in which its thickness becomes gradually thinner in the X direction and is formed of resin (synthetic resin), rubber (synthetic rubber), or the like which has more elastic deformation than the contact member 41 and is processed in a spongy shape. The contact member 41 is fixed to the elastic member 42 by an adhesive or the like and the elastic member 42 is fixed to the plate 43 by an adhesive or the like. The one planar surface may be a continuously flat surface with no step, or may have a curved surface.

In order to suppress the drying of the ink L, the nozzle contact unit 40 moves up so that the contact surface 40*p* of the contact member 41 comes into close contact with the nozzle formation surface 10*p* in the contact state. In this way, the contact surface blocks all of the regions of the nozzle openings K individually one by one. In other words, the contact member 41 and the elastic member 42 are deformed (elastically deformed) so that nearly the entire contact surface 40*p* of the contact member 41 comes into close contact with the nozzle formation surface 10*p*.

In the printing apparatus 100, the dryness suppressing device KYS having the above-described configuration is operated so that the contact surface 40*p* of the nozzle contact unit 40 is separated from the nozzle formation surface 10*p* in the separation procedure of the nozzle contact unit 40 from the contact state, as shown in FIG. 2B. Through the separation operation, the positions of meniscuses (not shown) formed in the respective nozzles NL1 to NL9 can be stabilized.

Before the separation operation shown in FIG. 2B is described, a method of flowing the ink L in a separation operation before application of this embodiment will first be described with reference to FIGS. 3A, 3B, and 3C in order to facilitate understanding of the method of flowing the ink L in the separation operation of separating the contact surface 40*p* in this embodiment.

Figure 3A:
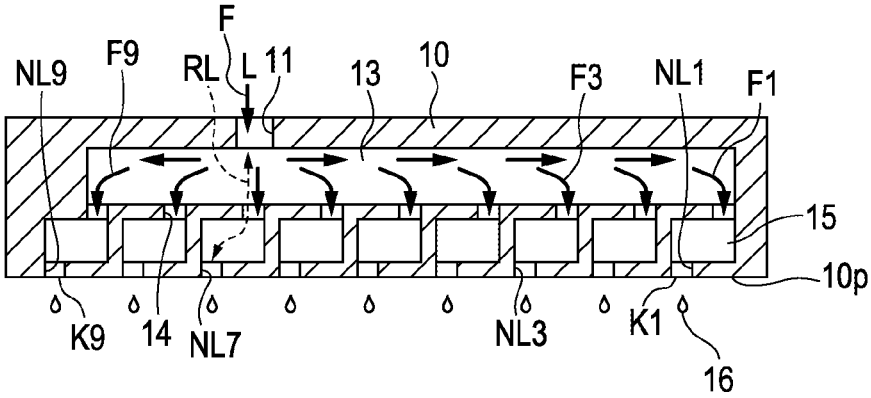
FIG. 3A is a diagram illustrating a method of flowing ink in a printing head according to the related art.
Figure 3B:
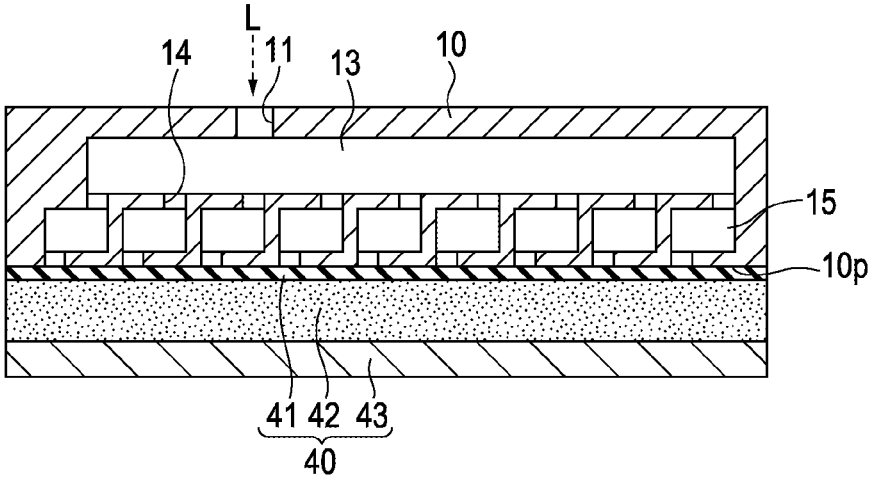
FIG. 3B is a diagram illustrating a method of flowing ink when an ejection liquid dryness suppressing device according to the related art comes into contact.
Figure 3C:
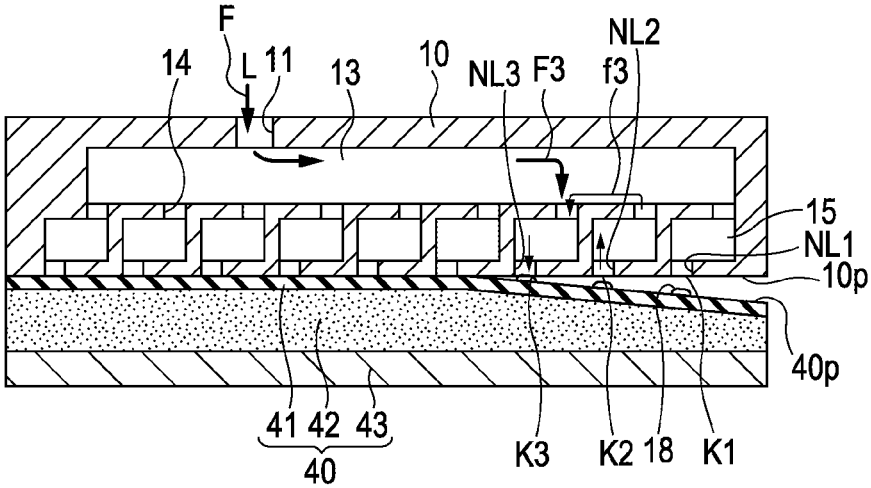
FIG. 3C is a diagram illustrating a method of flowing ink when the ejection liquid dryness suppressing device according to the related art is separated.

In FIGS. 3A to 3C, the printing head 10 and the nozzle contact unit 40 are cut along the nozzle row NR, as in FIG. 2B. FIG. 3A is a diagram illustrating the state where the ink droplets 16 are ejected from the respective nozzle openings K of the printing head 10 to form an image. FIG. 3B is a diagram illustrating the state where the contact member 41 comes into contact (close contact) with the nozzle formation surface 10*p* of the printing head 10 in the dryness suppressing device KYS. FIG. 3C is a diagram illustrating the state where the contact surface 40*p* of the contact member 41 is being separated from the nozzle formation surface 10*p* of the printing head 10. An example of the method of flowing the ink L is illustrated before this embodiment is applied. In FIGS. 3A, 3B, and 3C, the supply port 11 is formed not in the end nozzle (the nozzle NL1 or NL9) of the nozzle row NR but in the nozzle (here, the nozzle NL7) of the nozzle row NR in which the shortest flow passage length RL is formed.

In this embodiment, the flow passage length RL refers to the length of each flow passage along which the ink L flows from the supply port 11 to each of the nozzles NL via the common ink chamber 13. Specifically, for example, the length of a flow passage from the shape center of the supply port 11 to the shape center of the inflow port of the ink L in each nozzle NL can be used. When the communication flow passage 14 and the pressurizing chamber 15 formed in each of the nozzles NL1 to NL9 have the same shape as one another, the length of the flow passage for the ink L from the supply port 11 to the communication flow passage 14 via the common ink chamber 13 may be used as the flow passage length RL. Moreover, the length of the flow passage for the ink L flowing up to the pressurizing chamber 15 may be used as the flow passage length RL.

However, when an image is being formed, as shown in FIG. 3A, the ink L (indicated by the arrow F) supplied to the supply port 11 is supplied to each of the nozzles NL1 to NL9 via the common ink chamber 13. For example, the ink L flows in the common ink chamber 13 and is supplied to the nozzles NL1, NL3, and NL9, as indicated by arrows F1, F3, and F9, respectively. Accordingly, for example, the ink L in the nozzles does not flow from one of the adjacent nozzles to the other thereof, and the position of each meniscus formed in each of the nozzles NL1 to NL9 is not considerably changed from the determined position and thus is stabilized. As a consequence, the respective nozzles NL1 to NL9 are in the state where the ink droplets 16 are correctly ejected from the respective nozzle openings K1 to K9 in accordance with an image to be formed. Of course, this state is satisfied irrespective of the position at which the supply port 11 is formed, that is, irrespective of the position of the nozzle NL with the shortest flow passage length RL.

Next, when the ink droplets 16 are not ejected, as shown in FIG. 3B, the contact surface 40*p* of the contact member 41 is brought into close contact with the nozzle formation surface 10*p* so that the ink L is not dried in the nozzle openings K1 to K9. Specifically, the nozzle contact unit 40 is moved up to the nozzle formation surface 10*p* of the printing head 10 moved in the sliding manner to the position facing the nozzle contact unit 40 so as to come into close contact with the contact surface 40*p* of the contact member 41 (see FIG. 1). Of course, in the close contact state, that is, the state where the nozzle openings K1 to K9 are blocked by the contact surface 40*p*, the ink L supplied from the supply port 11 does not flow to any nozzle NL.

Next, the contact surface 40*p* of the nozzle contact unit 40 is separated from, for example, the nozzle opening K1 located in the end of the nozzle row NR so as to open the close contact state without dependency on the flow passage length RL from the supply port 11 to each of the nozzles NL1 to NL9. In such a separation operation, the nozzle opening K3 of the nozzle NL3 is being opened, as shown in FIG. 3C.

As illustrated, the nozzle openings K1 and K2 of the nozzles NL1 and NL2 have already been opened in this state. In addition, the exuded ink L from the opened nozzles NL1 and NL2 remains as residual ink 18 on the contact surface 40*p* of the contact member 41. Likewise, in the nozzle NL3 in which the nozzle opening K3 is being opened, the ink L in the nozzle NL3 is drawn out (as indicated by an arrow in the drawing) due to the exudation of the ink L in the gap between the nozzle formation surface 10*p* and the contact surface 40*p* which are in the separated state. As the exudation of the ink, there are the exudation occurring due to the wetting property between the ink L and the contact surface 40*p* of the contact member 41, and the exudation occurring due to depressurization of the closed nozzle NL at the moment at which the contact member 41 becomes distant from the nozzle NL. In particular, the exudation of the ink of the latter frequently occurs when the contact member 41 is separated at a relatively fast speed. Therefore, the ink L is drawn in toward the nozzle NL3 from the common ink chamber 13 via the communication flow passage 14 so as to supplement the amount (corresponding to the amount of residual ink 18) of the ink L drawn out in the nozzle NL3. As for the drawn-in ink L, as illustrated, the ink L supplied from the supply port 11 flows (as indicated by the arrow F3) and the ink L also flows (as indicated by the arrow f3) from the adjacent nozzle NL2, in which the nozzle opening K2 has already been opened, due to the above-described reason.

In the state where the ink flows, although not illustrated, the flow passage length RL from the supply port 11 to the nozzle NL2 in which the nozzle opening K2 has already been opened is longer than the flow passage length RL from the supply port 11 to the nozzle NL3 in which the nozzle opening K3 is being opened (that is, becomes distant from the supply port 11). Therefore, the ink L (indicated by the arrow F) supplied from the supply port 11 may not flow in the nozzle NL2 with the flow passage length RL longer than that of the nozzle NL3, even when the ink L flows in the nozzle NL3 (as indicted by the arrow F3). As a consequence, since the ink L in the nozzle NL2 is decreased, the position of the meniscus formed in the nozzle NL2 is changed, that is, drawn in upward.

As is apparent from the above description, the nozzle NL1 in which the nozzle opening K1 is opened earlier than that of the nozzle NL2 is longer than the nozzle NL2 in the flow passage length RL from the supply port 11. Therefore, the ink L is decreased, and thus the position of the meniscus formed in the nozzle NL1 is changed. When the position of the meniscus is changed, there is a concern that the ink L may not be correctly ejected from the nozzle opening K2 (or the nozzle opening K1) and so-called dot omission may occur when an image is formed.

Here, the nozzle contact unit 40 according to this embodiment performs the following separation operation during the procedure from the contact state to the separated state. That is, the contact surface 40*p* is separated from the nozzle formation surface 10*p* so that the nozzle openings K are sequentially opened preferentially from the nozzle opening K of the nozzle NL with the shorter flow passage length RL for the ink flowing from the supply port 11 to the nozzle NL via the common ink chamber 13 among the nozzle openings K.

Referring back to FIG. 2B, the separation operation will be described. In this embodiment, as illustrated, the supply port 11 is formed at the end of the common ink chamber 13 and the flow passage length RL between the supply port 11 and the nozzle NL1 via the common ink chamber 13 is the shortest. The flow passage length RL between the supply port 11 and the nozzle gradually lengthens from the nozzle NL1 to the nozzle NL9. Accordingly, in this embodiment, the contact surface 40*p* can be separated from the nozzle formation surface 10*p* in the arrangement order of the nozzle openings by forming the inclined surface of the contact surface 40*p* as one planar surface. Accordingly, from the nozzle opening K1 of the nozzle NL1 to the nozzle opening K9 of the nozzle NL9, the nozzle openings K are opened preferentially from the nozzle NL with the shorter flow passage length RL.

In this way, by performing the separation operation from the nozzle opening K1 of the nozzle NL1 with the shorter flow passage length RL from the supply port 11 via the common ink chamber 13, the method of flowing the ink L can be made to differ from that before the application. For example, it is supposed that the nozzle opening K3 of the nozzle NL3 is in the open state, as in FIG. 3C. In this state, in the nozzle NL3, the ink L supplied from the supply port 11 (as indicated by the arrow F3) flows and the ink L flows (as indicated by the arrow f3) from the nozzle NL2 in which the nozzle opening K2 has already been opened. In this embodiment, the nozzle NL2 is shorter than the nozzle NL3, in which the nozzle opening K3 is being opened, in the flow passage length RL from the supply port 11. Accordingly, as for the ink L (indicated by the arrow F) supplied from the supply port 11, the flow (indicated by the arrow F2 in the drawing) of the ink L supplemented in the nozzle NL2 occurs in accordance with the flow (indicated by the arrow F3) of the ink L supplemented toward the nozzle NL3 in the common ink chamber 13. As a consequence, even when the ink L is decreased temporarily in the nozzle NL2 in which the nozzle opening K2 has already been opened, the ink L is supplied from the supply port 11 to the nozzle NL2 to supplement the amount of decrease in ink.

In this embodiment, as shown in FIG. 1, the two supply ports 11 and 12 are formed at the end positions on the same side in the X direction in the printing head 10. Therefore, the flow passage length RL of the nozzle NL1 is the shortest. Accordingly, the contact surface 40*p* may be separated from the end nozzle openings K of both nozzle rows NR on the same side, that is, the nozzle openings K1 of the two nozzle rows NR. Therefore, even when there is the plurality of nozzle rows NR, the contact surface 40*p* can be formed as one planar surface.

According to the above-described embodiment, it is possible to obtain the following advantages.

(1) In the separation operation, the ink L is supplied from the supply port 11 to the nozzle NL in which the nozzle opening K has already been opened, even when the ink L is decreased in the nozzle NL in which the nozzle opening K has already been opened. Therefore, the change in the amount of ink L in the nozzle NL is suppressed. As a consequence, since the position of the meniscus formed in each nozzle NL can be stabilized in the separated state, for example, it is possible to suppress the occurrence of the ejection failure in which the ink L is not ejected from each nozzle opening K. Accordingly, it is possible to correctly eject the ink droplets 16.

(2) The contact surface 40*p* is separated in the arrangement order of the nozzle openings. Therefore, even when there is a part which is not flat in the contact surface 40*p*, the nozzle openings K can be opened at high certainty in the arrangement order of the nozzle openings K, that is, in the order in which the flow passage length RL is shorter. Accordingly, it is possible to supplement the ink L at high certainty from the supply 11 so that the ink L is not decreased in the nozzle NL in which the nozzle opening K has already been opened. As a consequence, since the change in the amount of ink L is suppressed in the nozzle NL in which the nozzle opening K has been opened, the position of the meniscus formed in each nozzle NL can be stabilized in the separated state.

(3) Since the contact surface 40*p* can be separated from the nozzle formation surface 10*p* in the order from the nozzle opening K located at the furthest end of the nozzle row NR, the contact surface 40*p* can be separated reliably and easily in the arrangement order of the nozzle openings, that is, the order in which the flow passage length RL is shorter. As a consequence, for example, it is possible to reliably supplement the amount of ink L decreased in the nozzle NL in which the nozzle opening K has already been opened, from the supply port 11. Accordingly, the position of the meniscus formed in each nozzle NL can be stabilized in the separated state.

(4) Since the plurality of nozzle rows NR can be covered with the contact surface 40*p* formed as one planar surface, the nozzle contact unit 40 can be easily configured. Moreover, when the contact surface is separated, the nozzle openings K of the respective nozzle rows NR can be opened in the arrangement order of the nozzle openings K at high certainty. As a consequence, since the ink L can be supplement at high certainty from the supply port 11 to the nozzle NL in which the nozzle opening K has already been opened in the separation operation, the position of the meniscus formed in each nozzle NL can be stabilized in the separated state.

(5) By providing the dryness suppressing device KYS according to this embodiment, it is possible to obtain the printing apparatus with the advantages (1) to (4) described above.

Second Embodiment

Next, a second embodiment of the invention will be described. In a dryness suppressing device KYS according to the second embodiment, a plurality of supply ports is formed for one nozzle row NR installed in the printing head 10. Hereinafter, this embodiment will be described with reference to FIGS. 4A and 4B.

Figure 4A:
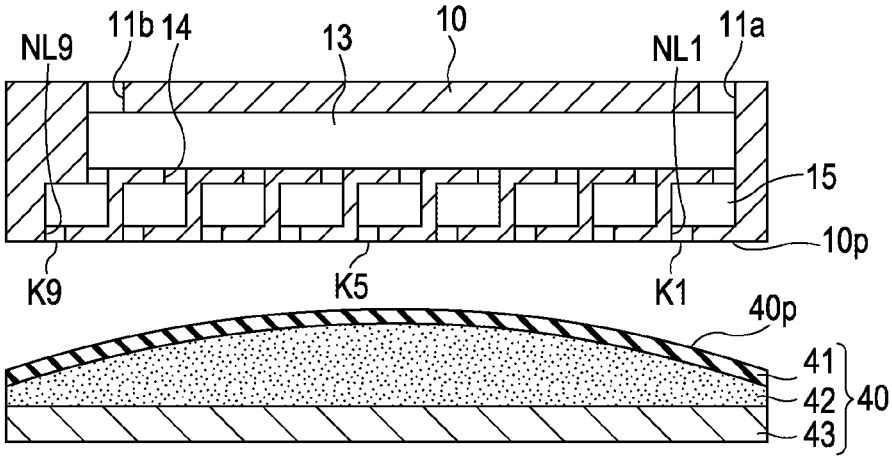
FIG. 4A is a diagram illustrating an ejection liquid dryness suppressing device in a separation state according to a second embodiment.
Figure 4B:
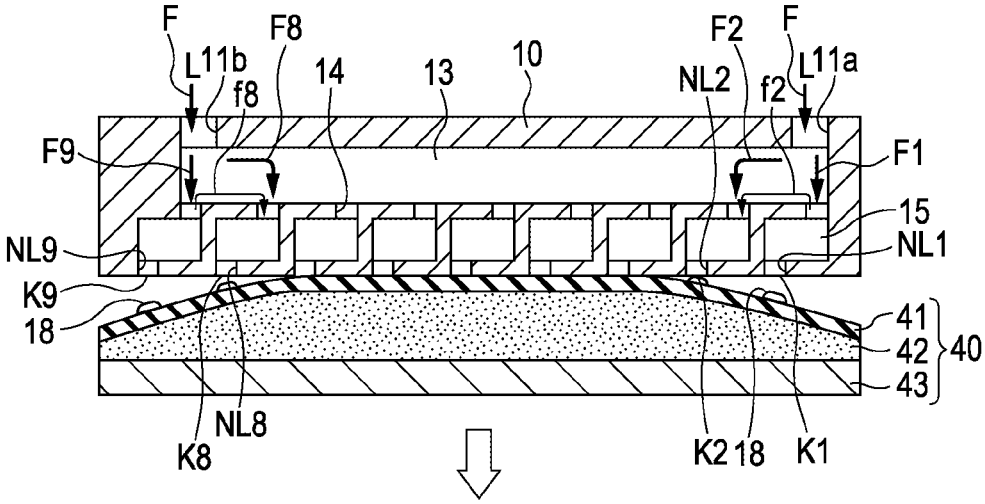
FIG. 4B is a diagram illustrating a method of flowing ink in a printing head by the ejection liquid dryness suppressing device during a procedure from a contact state to a separated state according to the second embodiment.

In FIGS. 4A and 4B, the printing head 10 and the nozzle contact unit 40 are cut along the nozzle row NR as in FIG. 2A of the first embodiment. FIG. 4A is a diagram illustrating the state where the nozzle contact unit 40 is separated from the nozzle formation surface 10*p* of the printing head 10 in the dryness suppressing device KYS. FIG. 4B is a diagram illustrating the nozzle formation surface 10*p* of the printing head 10 during the procedure in which the contact surface 40*p* of the contact member 41 is being separated from the nozzle formation surface 10*p* of the printing head 10.

In this embodiment, as shown in FIG. 4A, a plurality of supply ports, that is, two supply ports 11*a* and 11*b* are formed in both ends of the common ink chamber 13. As for the supply port 11*a*, the flow passage length RL for the ink flowing via the common ink chamber 13 is the shortest for the nozzle NL1 and becomes longer toward the nozzle NL9. As for the supply port 11*b*, the flow passage length RL for the ink flowing via the common ink chamber 13 is the shortest for the nozzle NL9 and becomes longer toward the nozzle NL1.

In this embodiment, the contact surface 40*p* is separated from the nozzle formation surface 10*p* in the order from the nozzle opening K1 of the nozzle NL1 with the shortest flow passage length RL for the supply port 11*a* to the nozzle opening K9. On the other hand, the contact surface 40*p* is separated from the nozzle formation surface 10*p* in the order from the nozzle opening K9 of the nozzle NL9 with the shortest flow passage length RL for the supply port 11*b* to the nozzle opening K1. In the dryness suppressing device KYS according to this embodiment, the nozzle contact unit 40 simultaneously performs the separation operation.

Specifically, in this embodiment, as illustrated, the contact surface 40*p* of the contact member 41 has one cylindrical surface with a maximum convex portion at the nearly middle position (herein, the position of the nozzle opening K5) between the nozzle openings K1 and K9 in the separated state. With such a configuration, the close contact state is nearly simultaneously opened from the nozzle openings K1 and K9 located at both ends of the nozzle row NR, when the contact surface 40*p* is separated from the nozzle formation surface 10*p*. In this embodiment, the elastic member 42 has a shape matched with the shape of the contact member 41. When the contact surface 40*p* comes into contact with the nozzle formation surface 10*p*, the contact surface 40*p* is configured to be closely contacted with the nozzle formation surface 10*p*. Of course, the contact member 41 may have one planar shape (for example, a mountain-like shape) other than the cylindrical surface, as long as the contact surface 40*p* has a shape opened from the close contact state sequentially from the nozzle openings K1 and K9 located at both ends of the nozzle row.

A method of flowing the ink L during the procedure from the contact state of the nozzle contact unit 40 with the above-described configuration to the separated state will be described with reference to FIG. 4B. Here, the method of flowing the ink L is basically the same as the method of flowing the ink L described with reference to FIG. 2B.

That is, when the nozzle opening K2 is being opened, as illustrated, the ink L supplied from the supply port 11*a* flows (as indicated by the arrow F2) in the nozzle NL2 and the ink L flows (as indicated by the arrow f2) in the nozzle NL1 in which the nozzle opening K1 has already been opened. At this time, the nozzle NL1 is shorter than the nozzle NL2, in which the nozzle opening K2 is being opened, in the flow passage length RL for the ink flowing from the supply port 11*a*. Accordingly, when the ink L (indicated by the arrow F) supplied from the supply port 11*a* flows toward the nozzle NL2 in the common ink chamber 13, the ink L flows (as indicated by the arrow F1) to supplement the ink L (indicated the arrow f2) flowing toward the nozzle NL1 and flowing from the nozzle NL1. As a consequence, even when the ink L is decreased temporarily in the nozzle NL1 in which the nozzle opening K1 has already been opened, the ink L is supplied from the supply port 11*a* so as to supplement the amount of decrease in ink.

Likewise, when the nozzle opening K8 is being opened, the ink L supplied from the supply port 11*b* flows (as indicated by the arrow F8) in the nozzle NL8 and the ink L flows (as indicated by the arrow f8) in the nozzle NL9 in which the nozzle opening K9 has already been opened. At this time, the nozzle NL9 is shorter than the nozzle NL8, in which the nozzle opening K8 is being opened, in the flow passage length RL for the ink flowing from the supply port 11*b*. Accordingly, when the ink L (indicated by the arrow F) supplied from the supply port 11*b* flows toward the nozzle NL8, the ink L flows (as indicated by the arrow F9) to supplement the ink L (indicated the arrow f8) flowing toward the nozzle NL9 and flowing from the nozzle NL9. As a consequence, even when the ink L is decreased temporarily in the nozzle NL9 in which the nozzle opening K9 has already been opened, the ink L is supplied toward the nozzle NL9 from the supply port 11*b* so as to supplement the amount of decrease in ink.

According to the above-described second embodiment, it is possible to obtain the following advantages in addition to the advantages (1) to (4) of the first embodiment.

(6) When the two (plurality of) supply ports 11*a* and 11*b* are formed in one nozzle row NR, the contact surface 40*p* is separated so that the supply ports are formed for which the flow passage length RL of the nozzle NL in which the nozzle opening K has already been opened is shorter than that of the nozzle NL in which the nozzle opening K is being opened. Therefore, even when the plurality of supply ports is formed, the amount of decrease in ink L in the nozzle NL in which the nozzle opening K has already been opened can be reliably supplemented from the supply port in the separation operation. Therefore, the position of the meniscus formed in each nozzle can be stabilized in the separated state.

(7) The printing apparatus 100 can obtain the advantage (6) by providing the dryness suppressing device KYS according to this embodiment.

Third Embodiment

Next, a third embodiment will be described. In the first embodiment, the supply port 11 (the supply port 12) is formed at the end in the X direction in the printing head 10. However, the supply port 11 (the supply port 12) may be formed at the position other than the end. That is, in this embodiment, the supply port 11 is formed near the middle of the printing head 10 unlike the above-described first embodiment. As a consequence, the nozzle NL with the shortest flow passage length RL for the ink flowing from the supply port 11 is the nozzle NL other than the nozzle NL1 or NL9 located at the ends of the nozzle row NR.

Figure 5A:
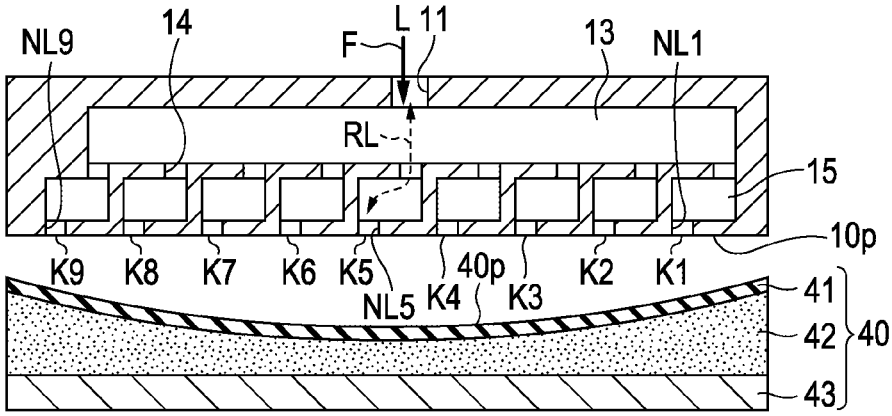
FIG. 5A is a diagram illustrating an ejection liquid dryness suppressing device in a separation state according to a third embodiment.
Figure 5B:
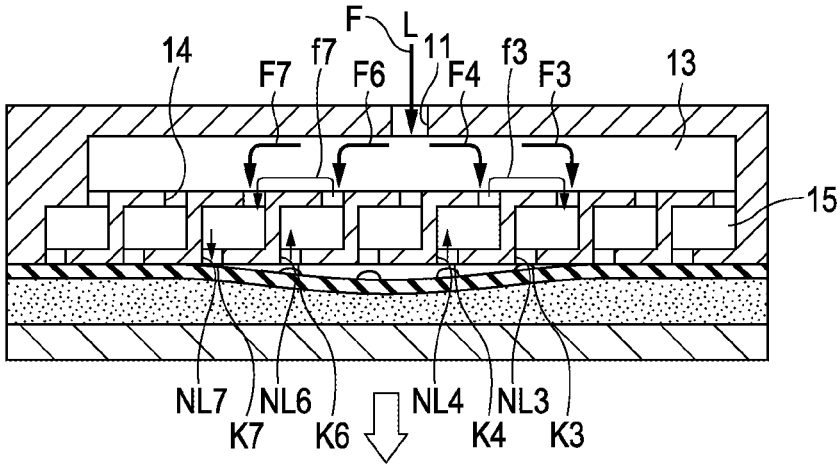
FIG. 5B is a diagram illustrating a method of flowing ink in a printing head by the ejection liquid dryness suppressing device during a procedure from a contact state to a separated state according to the third embodiment.

This embodiment will be described with reference to FIGS. 5A and 5B. In this embodiment, it is assumed that the supply port 11 is formed at the position at which the flow passage length RL between the nozzle opening K5 and the supply port is the shortest among the nozzle openings K1 to K9, as illustrated. In this case, as shown in FIG. 5A, the dryness suppressing device KYS according to this embodiment is configured so that the contact surface 40*p* is separated from the nozzle formation surface 10*p* in both directions of the nozzle openings K1 and K9 from the nozzle opening K5 of the nozzle NL5 with the shortest flow passage length RL for the ink flowing from the supply port 11.

Specifically, as illustrated, the contact member 41 has a concave shape in which the surface coming into contact with the nozzle opening K5 is nearly the lowest and an inclined surface gradually increases toward the upper side of the nozzle openings K1 and K9 located at both ends in the separated state. The elastic member 42 has a shape matched with the shape of the contact member 41. When the contact surface 40*p* comes into contact with the nozzle formation surface 10*p*, the contact surface 40*p* is configured to be closely contacted with the nozzle formation surface 10*p*. Thus, when the contact surface 40*p* is separated from the nozzle formation surface 10*p*, the nozzle opening K5 is first opened, and then the nozzle openings K located at both sides of the nozzle opening K5 are sequentially opened in the arrangement order. That is, the nozzle openings K4, K3, K2, and K1 are sequentially opened in the arrangement order from the nozzle opening K5. Moreover, the nozzle openings K6, K7, K8, and K9 are sequentially opened in the arrangement order from the nozzle opening K5.

A method of flowing the ink L during the procedure from the contact state of the nozzle contact unit 40 with the above-described configuration to the separated state will be described with reference to FIG. 5B. When the nozzle opening K3 of the nozzle NL3 and the nozzle opening K7 of the nozzle NL7 are currently being opened, as illustrated, the ink L supplied from the supply port 11 flows (as indicated by the arrow F3) in the nozzle NL3 and the ink L flows (as indicated by the arrow f3) in the nozzle NL4 in which the nozzle opening K4 has already been opened. At this time, the nozzle NL4 is shorter than the nozzle NL3, which is being opened, in the flow passage length RL for the ink flowing from the supply port 11. Therefore, the ink L (indicated by the arrow F) supplied from the supply port 11 flows toward the nozzle NL4 when the ink L flows toward the nozzle NL3. Thus, the ink flows (as indicated by the arrow F4) to supplement the ink L (indicated by the arrow f3) flowing from the nozzle NL4. As a consequence, even when the ink L is decreased temporarily in the nozzle NL4 in which the nozzle opening K4 has already been opened, the ink L is supplied from the supply port 11 so as to supplement the amount of decrease in ink.

Likewise, when the nozzle opening K7 of the nozzle NL7 is being opened, the ink L supplied from the supply port 11 flows (as indicated by the arrow F7) in the nozzle NL7 and the ink L flows (as indicated by the arrow f7) in the nozzle NL6 in which the nozzle opening K6 has already been opened. At this time, the nozzle NL6 is shorter than the nozzle NL7 in the flow passage length RL for the ink flowing from the supply port 11. Therefore, the ink L (indicated by the arrow F) supplied from the supply port 11 flows toward the nozzle NL6 when the ink L flows toward the nozzle NL7. Thus, the ink flows (as indicated by the arrow F6) to supplement the ink L (indicated by the arrow f7) flowing from the nozzle NL6. As a consequence, even when the ink L is decreased temporarily in the nozzle NL6 in which the nozzle opening K6 has already been opened, the ink L is supplied from the supply port 11 so as to supplement the amount of decrease in ink.

Accordingly, even when the supply port 11 (the supply port 12) of the ink L is located at any position in the printing head 10, the nozzle openings may start be opened from the nozzle opening of the nozzle with the flow passage length RL for the ink flowing from the supply port 11 via the common ink chamber 13. Thus, the position of the meniscus formed in each nozzle can be stabilized in the separated state.

Figure 6:
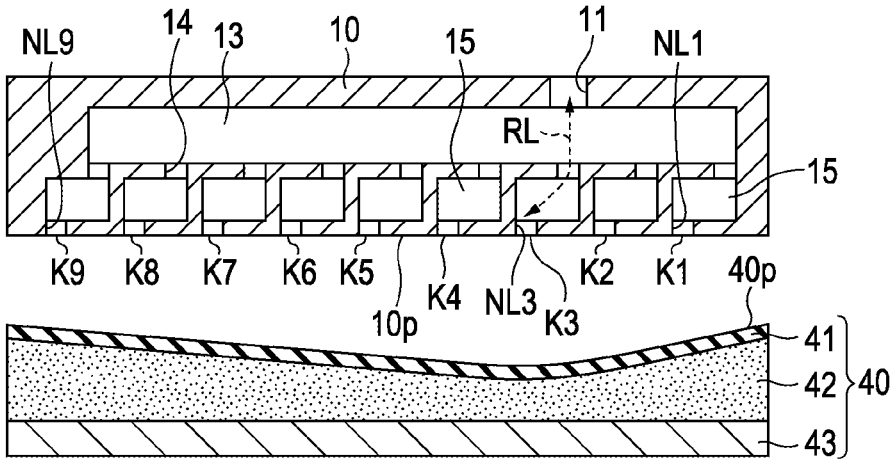
FIG. 6 is a diagram illustrating a method of flowing ink in a printing head by the ejection liquid dryness suppressing device according to another example of the third embodiment.

For example, referring to FIG. 6, a case will be described in which the supply port 11 is formed at the position closer to the middle than the end of the printing head 10 according to another example of this embodiment. As an example of this case, it is assumed that the supply port 11 is formed at a position at which the flow passage length RL between the supply port and the nozzle NL3 of the nozzle opening K3 close to the nozzle opening K1 located at the end of the nozzle row NR is the shortest among the nozzle openings K1 to K9, as illustrated. In this case, as illustrated, the dryness suppressing device KYS is configured so that the contact surface 40*p* is separated from the nozzle formation surface 10*p* in both directions of the nozzle openings K1 and K9 from the nozzle opening K3 of the nozzle NL3 with the shortest flow passage length RL for the ink flowing from the supply port 11.

Specifically, as illustrated, the contact member 41 has a concave shape in which a surface coming into contact with the nozzle opening K3 is nearly the lowest and an inclined surface gradually increases upward the nozzle openings K1 and K9 located at both ends in the separated state. The elastic member 42 has a shape matched with the shape of the contact member 41. When the contact surface 40*p* comes into contact with the nozzle formation surface 10*p*, the contact surface 40*p* is formed to be closely contacted with the nozzle formation surface 10*p*.

Thus, when the nozzle contact unit 40 is moved (lowered) and thus the contact surface 40*p* is separated from the nozzle formation surface 10*p*, the nozzle opening K3 is first opened, and then the nozzle openings located at both sides of the nozzle opening K3 are sequentially opened in the arrangement order. That is, the nozzle openings K2 and K1 are sequentially opened in the arrangement order from the nozzle opening K3. Moreover, the nozzle openings K4 to K9 are sequentially opened in the arrangement order from the nozzle opening K3. In this embodiment, the method of flowing the ink L during the procedure from the contact state of the nozzle contact unit 40 with the above-described configuration to the separated state is the same as the method described with reference to FIG. 5B. Therefore, the description thereof will not be repeated.

Thus, it is possible to suppress the decrease in the ink L in the nozzle NL in which the nozzle opening K is opened, by opening the nozzle openings K in the order from the nozzle opening K (here, the nozzle opening K3) of the nozzle with the shortest flow passage length RL for the ink flowing from the supply port 11 via the common ink chamber 13.

In this embodiment, the same configuration may be realized even when the plurality of supply ports is formed for one nozzle row NR, as in the above-described second embodiment. That is, the nozzle openings K may be opened in the order from the nozzle opening K of the nozzle NL with the shortest flow passage length RL for each supply port. For example, when two supply ports are formed, although not illustrated, the nozzle contact unit 40 may open the nozzle openings K in the order from two nozzle openings K by bringing the contact surface 40*p* formed in a W shape into contact with the nozzle formation surface 10*p* and separating the contact surface 40*p* from the nozzle formation surface 10*p*.

According to the third embodiment described above, it is possible to obtain the following advantages in addition to the advantages (1) to (4) of the first embodiment.

(8) Even when the nozzle NL with the shortest flow passage length RL for the ink flowing from the supply port 11 via the common ink chamber 13 is not located at the end of the nozzle row NR, the nozzle openings K can be opened from the nozzle opening K with the shortest flow passage length RL. When the nozzle opening K of the nozzle NL with the shortest flow passage length RL is located in the middle of the nozzle row NR, the nozzle openings K arranged at both sides of the nozzle opening K located in the middle of the nozzle row NR are simultaneously opened during the procedure in which the contact surface 40*p* is separated from the nozzle formation surface 10*p*. Therefore, since it is possible to shorten the time at which all of the nozzle openings K are opened, the advantage of shortening the time at which an image is formed can be obtained.

(9) The printing apparatus 100 can obtain the advantage (8) by providing the dryness suppressing device KYS according to this embodiment.

The above-described embodiments may be modified in the following forms.

The nozzle NL with the shortest flow passage length RL for the ink flowing from the supply port 11 via the common ink chamber 13 in the first embodiment may not be the nozzle NL of the nozzle opening K at the end of the nozzle row NR, but may be the nozzle NL of the nozzle opening K near the end of the nozzle row NR. For example, as in the above-described third embodiment (see FIG. 6), the nozzle NL3 of the nozzle opening K3 located closer to the nozzle opening K1 than the middle of the nozzle row NR may be the nozzle NL with the shortest flow passage length RL for the ink flowing from the supply port 11.

Figure 7:
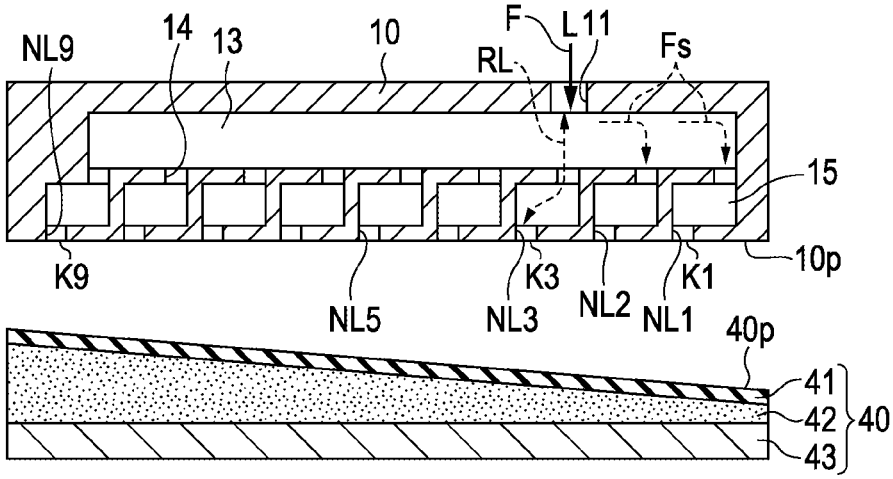
FIG. 7 is a diagram illustrating a method of flowing ink in the printing head by the ejection liquid dryness suppressing device according to a modified example.

This modified example is shown in FIG. 7. FIG. 7 is a diagram illustrating the shortest flow passage length RL between the nozzle NL3 and the supply port 11 of which the position is moved from the end of the printing head 10, as in the third embodiment, in the dryness suppressing device KYS (see FIG. 2B) of the above-described first embodiment. The nozzle contact unit 40 is in the separated state.

In this modified example, as illustrated, the nozzle openings are opened in the order from the nozzle opening K1 located at the end of the nozzle row NR to the nozzle opening K9, when the contact surface 40*p* with the inclined surface formed as one planar surface is separated from the nozzle formation surface 10*p*, as in the first embodiment. At this time, the nozzles, in which the nozzle openings are opened earlier, are shorter than the nozzles, in which the nozzle openings are later opened, in the flow passage length RL between the supply port 11 and each nozzle, after the nozzle opening K3 of the nozzle NL3 is opened. Accordingly, since the nozzle openings K of the nozzles NL3 to NL9 are sequentially opened preferentially from the nozzle opening K of the nozzle NL with the shorter flow passage length RL, the decrease in the ink L in the nozzles NL3 to NL9 is suppressed by the ink L flowing from the supply port 11.

On the other hand, as for the nozzles NL1 and NL2, as described above, the nozzle NL in which the nozzle opening K is opened earlier is longer than the nozzle NL in which the nozzle opening K is opened later in the flow passage length RL between the supply port 11 and each nozzle. Therefore, as described above, there is a concern that the ink L in the nozzle may be decreased.

In some cases, the nozzle row NR has many nozzle openings K. For example, when several hundreds of nozzle openings K to several thousands of nozzle openings K are formed, it takes considerable time to separate the contact surface 40*p* of the nozzle contact unit 40 from the nozzle opening K3 to the final nozzle opening (that is, the nozzle opening K800). Even in this case, the ink L (indicated by the arrow F) supplied from the supply port 11 gradually flows (as indicated by the arrow Fs) toward the nozzles NL1 and NL2 via the common ink chamber 13 by the surface tension or the like of the ink L occurring in the nozzles NL1 and NL2. Then, within the corresponding time, the amount of ink L decreased in the nozzle is sometimes supplemented in the nozzle NL1 or NL2.

In this case, even when the nozzle opening K with the shortest flow passage length RL for the ink flowing from the supply port 11 is not the nozzle opening K at the end of the nozzle row NR, the decreased state of the ink L is prevented in all of the nozzles NL in which the nozzle openings K are opened in this separated state. Accordingly, the nozzle contact unit 40 may be configured so that the nozzle openings K are opened in the arrangement order from the nozzle opening K located at the end of the nozzle row NR.

Accordingly, even when the nozzle opening K with the shortest flow passage length RL is located at the end of the nozzle row NR, the contact surface 40*p* may be separated in the order from the nozzle opening K located at the end of the nozzle row NR in a case where the amount of decrease in ink L is recovered in the nozzle in which the nozzle opening K has already been opened. Then, since the contact surface 40*p* can be formed as one planar surface, the contact surface 40*p* can be easily formed and there is a high possibility that the nozzle openings K are opened in the arrangement order. As a consequence, since the change in the amount of ink L in the nozzle is suppressed in the nozzles NL in which the nozzle openings K are opened, as described above, it is possible to prevent a change in the position of the formed meniscus.

In the dryness suppressing device KYS according to the above-described embodiments, the printing head 10 is moved in the X direction and the nozzle formation surface 10*p* is located above the nozzle contact unit 40. However, the invention is not limited thereto. For example, the printing head 10 may be rotated in a planar surface in the transport direction of the sheet S and the nozzle formation surface 10*p* may be located above the nozzle contact unit 40. Alternatively, the nozzle contact unit 40 may be disposed at a position planarly deviated from the platen 33. Moreover, the printing head 10 may be configured to move up and down with respect to the contact member 41.

In the first embodiment, the nozzle NL with the shortest flow passage length RL from the supply ports 11 and 12 is the nozzle NL1 of the nozzle opening K1 at the end of the nozzle row NR on the same side in the X direction. Of course, the invention is not limited thereto. For example, the nozzle NL with the shortest flow passage length RL may be the nozzles NL1 and NL9 at the ends opposite to each other in the X direction. In this case, the supply ports 11 and 12 are located near the ends opposite to each other in the printing head 10. In this case, the contact member 41 of the nozzle contact unit 40 may have the contact surface 40*p* in which the inclinations are opposite to each other in the X direction.

In the above-described embodiments, there may be provided a so-called serial head-type printing apparatus 100 in which the nozzle row NR is formed in the Y direction on the nozzle formation surface 10*p* and the printing head 10 is configured to reciprocate in the X direction. Moreover, the printing head 10 may be fixed to the carriage reciprocating in the X direction. Furthermore, the ink supply unit 20 may be mounted on the printing head 10 or the carriage.

In the above-described embodiment, the liquid ejecting apparatus is the printing apparatus 100 ejecting the ink as the ejection liquid, but may be a printing apparatus ejecting or discharging other liquids other than ink. There may be various kinds of printing apparatuses including a printing head or the like ejecting a minute amount of liquid droplet. The liquid droplet is a liquid ejected from the printing apparatus and includes a granular shape, a tear shape, a shape with a tail pulled into thread form. The liquid mentioned herein may be a material which can be ejected by the printing apparatus. For example, the material may be a liquid-phase material and includes a fluid-state material, such as a liquid-form material with high viscosity or low viscosity, sol, gel water, other inorganic solvent, organic solvent, liquid solution, liquid-form resin, and liquid-form metal (metallic melt), and a material in which particles with a functional material formed of a solid matter such as a pigment or a metal particle as well as a liquid serving as a one-state material are dissolved, dispersed, or mixed in a solvent. A representative example of a liquid is ink described in the above-described embodiments. Here, ink includes various kinds of liquid compositions such as water-based ink, oil-based ink, gel ink, and hot-melt ink. A specific example of the printing apparatus is a printing apparatus ejecting a liquid in which a material such as an electrode material or a color material used to manufacture a liquid crystal display, an EL (Electro-Luminescence) display, a surface-emitting display, a color filter, or the like is dispersed or dissolved. Alternatively, a textile printing apparatus, a micro dispenser, or the like may be used. The invention is applicable to any one of these printing apparatuses.

In the above-described embodiments, the printing apparatus has been described as a liquid ejecting apparatus including the ejection liquid dryness suppressing apparatus according to the invention. As is apparent from the above description, the embodiment of the invention is applicable to a method of controlling the ejection liquid dryness suppressing device. According to this method, it is possible to obtain the same advantages as those of the embodiments.

What is claimed is:

1. An ejection liquid dryness suppressing device comprising:

a liquid ejecting unit including a plurality of nozzles which ejects an ejection liquid from a plurality of nozzle openings formed in a nozzle formation surface, a common liquid chamber which communicates with the plurality of nozzles and supplies the ejection liquid to the plurality of nozzles, and a supply port through which the ejection liquid is supplied to the common liquid chamber; and a nozzle contact unit having a contact surface which is able to come into contact with the nozzle formation surface during a contact state, the contact surface coming into close contact with nozzle formation surface to block the plurality of nozzle openings during the contact state and wherein during a separation state, where the contact surface separates from the nozzle formation surface, the contact surface first separates from the nozzle opening having a shortest flow passage length from the supply port via the common liquid chamber, the contact surface then sequentially separating from the nozzle opening with the next shortest flow passage length to the nozzle opening with the longest flow passage length.

2. The ejection liquid dryness suppressing device according to claim 1, wherein the plurality of nozzle openings is arranged in a nozzle row in one direction on the nozzle formation surface and the flow passage length becomes longer in an arrangement order of the nozzle row from the nozzle opening of the nozzle with the shortest flow passage length.

3. The ejection liquid dryness suppressing device according to claim 2, wherein the nozzle with the shortest flow passage length for the ejection liquid from the supply port to the nozzle is the nozzle of the nozzle opening located at the furthest end of the nozzle row.

4. The ejection liquid dryness suppressing device according to claim 3, wherein in the liquid ejecting unit, a plurality of the nozzle rows arranged in a row direction is formed on the nozzle formation surface, and wherein the nozzle with the shortest flow passage length for the ejection liquid flowing from the supply port to the nozzle is each of the nozzles located at the furthest ends of the plurality of nozzle rows on the same side.

5. The ejection liquid dryness suppressing device according to claim 2, wherein the nozzle with the shortest flow passage length for the ejection liquid from the supply port to the nozzle is the nozzle of the nozzle opening located at the middle of the nozzle row.

6. The ejection liquid dryness suppressing device according to claim 2, wherein the liquid ejecting unit has a plurality of the supply ports in one nozzle row, and wherein the contact surface of the nozzle contact unit is separated from the nozzle formation surface from the nozzle openings with the shortest flow passage length in the plurality of supply ports so as to simultaneously begin opening the plurality of nozzle openings.

7. A liquid ejecting apparatus comprising:

the ejection liquid dryness suppressing device according to claim 1; and a movement unit relatively moving the liquid ejecting unit of the ejection liquid dryness suppressing device and a medium to which an ejection liquid is ejected.

8. A liquid ejecting apparatus comprising:

the ejection liquid dryness suppressing device according to claim 2; and a movement unit relatively moving the liquid ejecting unit of the ejection liquid dryness suppressing device and a medium to which an ejection liquid is ejected.

9. A liquid ejecting apparatus comprising:

the ejection liquid dryness suppressing device according to claim 3; and a movement unit relatively moving the liquid ejecting unit of the ejection liquid dryness suppressing device and a medium to which an ejection liquid is ejected.

10. A liquid ejecting apparatus comprising:

the ejection liquid dryness suppressing device according to claim 4; and a movement unit relatively moving the liquid ejecting unit of the ejection liquid dryness suppressing device and a medium to which an ejection liquid is ejected.

11. A liquid ejecting apparatus comprising:

the ejection liquid dryness suppressing device according to claim 5; and a movement unit relatively moving the liquid ejecting unit of the ejection liquid dryness suppressing device and a medium to which an ejection liquid is ejected.

12. A liquid ejecting apparatus comprising:

the ejection liquid dryness suppressing device according to claim 6; and a movement unit relatively moving the liquid ejecting unit of the ejection liquid dryness suppressing device and a medium to which an ejection liquid is ejected.

13. An ejection liquid dryness suppressing method comprising:

by a nozzle contact unit having a contact surface coming into contact with a nozzle formation surface of a liquid ejecting unit in which a plurality of nozzle openings of a plurality of nozzles ejecting an ejection liquid are formed, during a procedure from a contact state, where the contact surface comes into close contact with the nozzle formation surface to block the plurality of nozzle openings, to a separated state, where the contact state is separated from the nozzle formation surface, separating the contact surface first from the nozzle opening having a shortest flow passage length from the supply port via the common liquid chamber, the contact surface then sequentially separating from the nozzle opening with the next shortest flow passage length to the nozzle opening with the longest flow passage length.

* * * * *